United States Patent [19]

Gavinet et al.

[11] Patent Number: 4,606,884

[45] Date of Patent: Aug. 19, 1986

[54] COMPOSITE BILLET FOR HOT TRANSFORMATION

[75] Inventors: Jean Gavinet, Orsay; Bruno Childeric, Grenoble, both of France

[73] Assignees: Microfusion, Gennevilliers; Commissariat a l'Energie Atomique, Paris, both of France

[21] Appl. No.: 627,664

[22] Filed: Jul. 3, 1984

[30] Foreign Application Priority Data

Jul. 8, 1983 [FR] France ..... 83 11853

[51] Int. Cl.[4] ..... B22F 3/26

[52] U.S. Cl. ..... 419/27; 419/30; 419/35; 419/36; 419/37; 419/28; 419/41; 419/42; 419/54; 419/55; 419/38; 419/60; 419/66; 419/67; 419/68; 75/228

[58] Field of Search ..... 419/1, 3, 8, 21, 23, 419/28, 30, 32, 33, 35–38, 42, 46, 41, 48, 56, 66, 67, 60, 68, 54, 55, 27; 75/228

[56] References Cited

U.S. PATENT DOCUMENTS

| | | | |
|---|---|---|---|
| 3,892,030 | 7/1975 | DePierre et al. | 419/66 |
| 4,315,776 | 2/1982 | Pitler | 419/8 |
| 4,389,362 | 6/1983 | Larsson | 419/8 |
| 4,470,953 | 9/1984 | Bruce | 419/6 |
| 4,526,747 | 7/1985 | Schimmel et al. | 419/8 |

*Primary Examiner*—Stephen J. Lechert, Jr.

*Attorney, Agent, or Firm*—Dennison, Meserole, Pollack & Scheiner

[57] ABSTRACT

The present invention concerns the manufacture of bars, wires or profiled elements by hot transformation which may be followed by cold transformation. The invention particularly concerns a new process for the manufacture of a composite billet for hot transformation as well as a method for the manufacture of products which are difficult to transform by making use of such a composite billet.

21 Claims, 5 Drawing Figures

COMPOSITE BILLET FOR HOT TRANSFORMATION

The manufacture of elongated metal of alloy products which are difficult to transform by hot or cold plastic deformation has often required coverings of some sort. U.S. Pat. No. 2,050,298 describes a process for the manufacture of fine stainless steel wires by deformation, e.g. by drafting or rolling out a billet composed of a plurality of elements in a metal or plastic powder matrix which plays the role of a separator material between the individual elements of the bundle, with a tubular sheathing as container, wherein the matrix constitutes the greatest volume of the assembly.

French Pat. No. 1,147,236 describes hot extrusion in very small cross sections of metal wires which are very difficult to work hot, by using a composite extrusion process wherein the bundle of wires is surrounded by a thin soft steel covering which is removed following the extrusion, by a chemical or mechanical procedure. French Pat. No. 1,150,035 describes the covering of the billet to be extruded as a metal covering which is easy to extrude and describes the interposition of a lubricant such as glass between the extrusion tooling and the billet. U.S. Pat. No. 3,394,213 describes a process for the manufacture of filaments by hot transformation followed by cold drawing, wherein a composite billet is used which is comprised of an outside sheathing, tightly packed wires and optionally a powder binder, wherein the outside sheathing can be of Monel 400 or soft steel and the wire blanks of stainless steel AISI 304. French Pat. No. 2,347,989 describes a process for the transformation of massive pieces of refractory alloy, more precisely a process for the hot plastic deformation of said pieces, starting from a composite which is comprised at least of the piece or pieces (of refractory alloy) placed in a covering which is more than 0.5 mm thick and of lower resistance to hot plastic deformation than the refractory alloy, and, in the case of hot extrusion of several wire blanks, this covering is constituted either of a cylinder having a plurality of passages which receive the wire blanks and having a stopper placed tightly on the end, or of a stack of hexagonal tubes on the outside and cylindrical tubes on the inside and having two tight stoppers.

In all of the processes, the need is recognized of having a covering, sheathing, and sometimes a matrix which is/are easier to deform than the product of small cross section which is to be obtained. The thicker the covering, the easier it is to deform the composite billet which is obtained. Besides, in U.S. Pat. No. 3,277,564, not cited above, sheathing material fills the spaces which exist between the sheathed wires little by little and then plays the role of a matrix, conveying the stresses of drawing out and shaping. In this case, the inside sheathing or matrix as well as the outside covering plays a role of lubricant which favors the surfaces of the products being transformed under the sheathing. Finally, the outside covering is a protective covering to protect the products being transformed by hot processing from contamination. The covering is removed following the end of the hot processing or after a part of the cold transformation which succeeds it, most often by chemical dissolution.

Opposing the advantages thus obtained by covering of the billet for the plastic deformation of metals or alloys which are difficult to transform hot, the composition of this composite assembly is traditionally complicated and costly to manufacture because it uses either an outside covering having at least one end piece and a tubular sheathing, or a massive block with one or more passages, and it often requires welding operations and optional machine finishing operations.

The object of the invention is a process which is simpler and thus less costly for the manufacture of such composite billets. The invention precisely concerns a new process for the manufacture of a composite billet wherein one or more blanks of metal or alloy which is/are difficult to transform are arranged in a matrix having a hot plastic deformation resistance which is lower than that of the metal or alloy, the process characterized in that this matrix is constituted solely of the agglomerated powder, without sheathing or tubular covering. "Agglomerated powder" here means any powder with grains adhering together, whatever the process used to obtain it, e.g. compression, sintering, or both. The agglomeration of the powder is usually effected by compression of the billet, e.g. by isostatic compression between 100 and 300 MPa near ambient temperature, and this compression may be followed by sintering, which improves the agglomeration of the powder. The pressure can also be greater than 300 MPa. The agglomeration can also be obtained by sintering of the billet without compression, preferably by using a binder which causes agglomeration and sufficient cohesion of the tamped down powder and is totally or at least partially eliminated by the sintering treatment.

Iron powder can be used. As is known from EP application No. 0,045,706, concerning essentially iron base members which are compressed, the compression can be followed by oxidation taking place between 200° and 600° C., then optionally by impregnation with a liquid or pasty lubricant.

This same patent EP No. 0,045,706 teaches, in the case of the iron powder, that a solid lubricating powder can also be incorporated into the powder which constitutes the matrix, whether the compression is or is not followed by sintering, or, when mostly iron powder is used, by an oxidation between 200° and 600° C.

Finally, in the case of hot extrusion, it is particularly advantageous to provide extra lengths at the ends of the billet to be hot transformed, which are longer than the metal or alloy blanks which are difficult to transform, or to pull back the parts of the billet having higher resistance to hot deformation in relation to the beginning and end of the transformation, which may thus facilitate the beginning of the extrusion, either to improve the making correlative to the dimensional regularity of the transformed blanks toward their ends, or else to preserve the good seal of the covering during hot transformation.

Such extra lengths are obtained either solely by making a billet wherein the matrix of agglomerated powder is longer than the blanks, or by addition of a block of extra length to at least one end of the billet, the block having hot plastic deformation resistance which is lower than that of the metal or alloy of the blanks. The addition of the block or blocks of extra length can be effected either by juxtaposition during hot transformation, or beforehand by welding, instead of increasing the thickness of the powder at the ends of the billet.

The process of the invention is particularly useful for the hot transformation of blanks of refractory alloy containing at least 35% by weight of (Co+Ni).

The following drawings and examples will allow better understanding of the invention.

EXAMPLE 1

Manufacturing Operation of a Composite Billet According to the Invention

Figure 1:
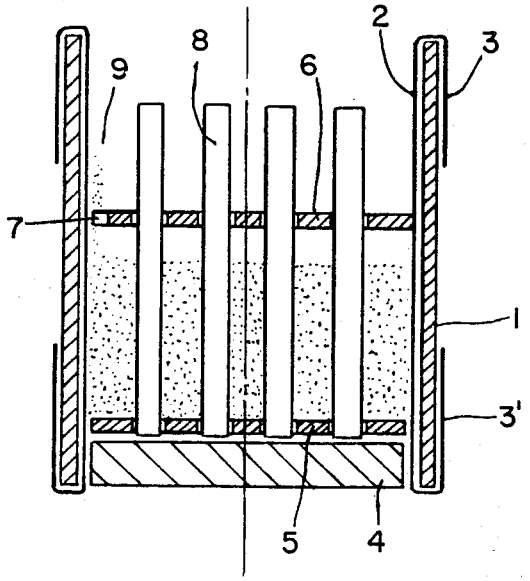
FIG. 1 is an axial cross-section of a billet for extrusion at the beginning of manufacture (Example 1)
Figure 2:
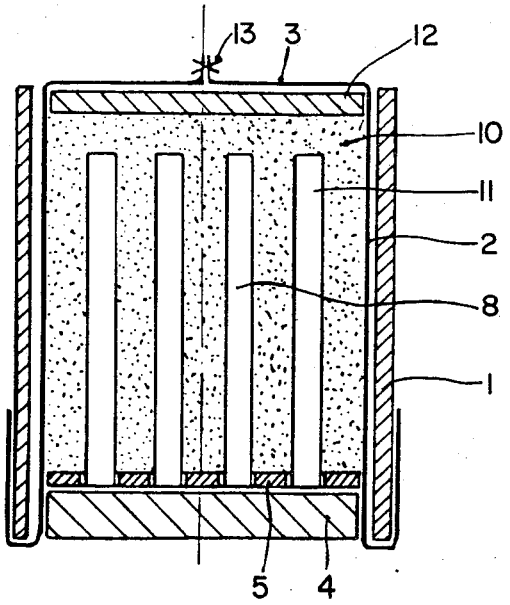
FIG. 2 is an axial cross-section of the same billet at the end of the first phase of manufacture.
Figure 3:
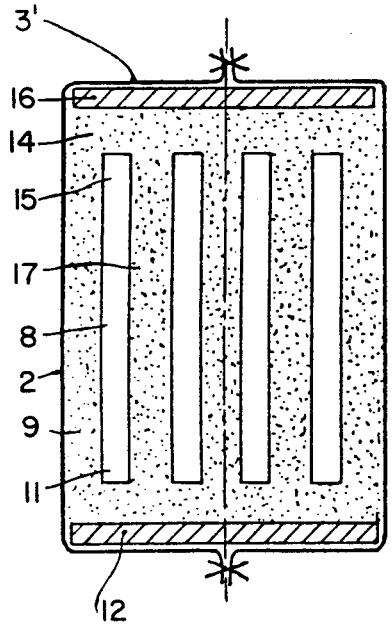
FIG. 3 is an axial cross-section of the same billet manufactured and ready for isostatic compression.

FIGS. 1 to 3 show a method of manufacture of the billet before agglomeration, using the process of the invention. A rigid cylindrical sheathing 1 is lined with a longer flexible sheathing 2, of which the ends 3 and 3' are folded back around the ends of rigid sheathing 1, and the covered sheathing 1+2 is mounted vertically on the work area around a stopper or sealing plug 4 which is rigid or semi-rigid (FIG. 1). A crossbar 5 perforated with holes of slightly greater dimensions than those of the straight sections of the blanks is placed on stopper 4 and a second crossbar 6 with orifices 7 on its periphery is placed preferably at about $\frac{2}{3}$ the height of the blanks, this second crossbar then being held at 3 or 4 points by a stirrup. The metal or alloy blanks 8 which are difficult to transform are then fed through the two crossbars with corresponding holes. Powder 9 is then poured into the mold which is thus formed, and flows through the orifices 7 and is packed down by taps on the side of rigid sheathing 1 or by vibration of the mold assembly. The powder is thus supplied and packed down until it reaches the vicinity of the second crossbar 6.

Crossbar 6 is then pulled back and filling in and packing of the powder is terminated (FIG. 2) with a thickness 10 in relation to the end 11 of blanks 8. A semi-rigid stopper 12, e.g. of hard synthetic rubber, is then placed on the powder and the end 3 of flexible sheathing 2 is closed over stopper 12 by a known means 13, e.g. with the aid of pliers or a clamping ring.

The assembly is then turned over, and stopper or sealing plug is withdrawn, together with crossbar 5. The assembly is then in the position of FIG. 3, which shows the billet ready for isostatic compression, following the final manufacturing operations which will be described hereinafter. Plug 4 and crossbar 5 are withdrawn, and the filling and packing of the powder are terminated with an extra thickness 14 at the end 15 of blanks 8. The construction of the billet is completed by the placing of a semi-rigid stopper 16 and the closing of end 3' of flexible sheathing 2 under a primary vacuum. Flexible sheathing 2 then constitutes a sealed bag flattened on billet 7 and stoppers 12 and 16, the powder 9 of the billet being packed but not yet agglomerated, and the billet is then ready for the operation of isostatic compression, the rigid sheathing 1 (FIG. 2) being removed.

Figure 4:
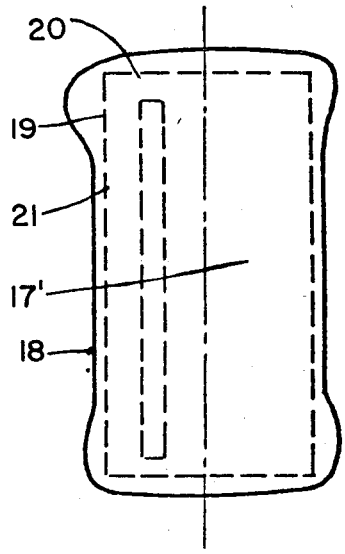
FIG. 4 is the billet of Example 2 following isostatic compression followed optionally by sintering, and its contour after machine finishing.

The isostatic compression of the billet which is thus sheathed (FIG. 3) is done at ambient temperature under a pressure on the order of 200 MPa and which can vary, according to the nature and the granulometry of the powders, from 100 to 300 MPa. Upon discharge from the isostatic compression, the billet is removed from the flexible sheathing 2 together with semi-rigid stoppers 12 and 16, and it is then deformed as shown in FIG. 4, relative to Example 2.

EXAMPLE 2

Manufacture of a Billet Containing Circular Cylindrical Refractory Blanks, Extrusion of this Composite Billet and Obtaining of Transformed Rods Rod blanks $\phi$ 6.2 mm have been made by continuous casting, with the following analysis (% by weight):

C=0.85 ·Si 1·Mn 1·Cr=27.5·Ni=5·W=19.5·Fe 3·Co—balance

The rod blanks had a hardness of HV30 570/585.

A billet for extrusion was made from 68 rod blanks, $\phi$6.2 mm, length per unit 490 mm, weighing a total of 9.05 kg and 30 kg of iron powder with granulometry between 0.02 and 0.15 mm. The rigid sheathing 1 had an inside diameter of 134 mm, a 3 mm thickness and 600 mm length. Flexible rubber sheathing 2 had a 2 mm thickness. Sealing plug 4 had a 30 mm thickness, and crossbars 5 and 7 has a 4 mm thickness, and had 68 holes, $\phi$ 6.3 to 6.5 mm, arranged in staggered rows with an average spacing of 5 mm. An extra thickness of powder of 30 mm was left at each end of billet 17 manufactured as described, of $\phi$ 130×550 mm dimensions.

Billet 17 enclosed in flexible sheathing 2 was treated by isostatic compression at ambient temperature under 210 MPa. It was then stripped of the sealed sheathing 2 and it had the shape shown in the diagram of FIG. 4, with the ends expanded. The central part 18 of the shaft of billet 17 deformed by isostatic compression had a mean diameter of 119 mm.

Following compression, billet 17' was sintered at 1150° C. under hydrogen. The shape of this billet 17' was slightly modified by sintering. Then the billet was machine finished to conform to the contour 19 of a diameter of 115 mm and a length of 520 mm, leaving an extra length 20 of agglomerated powder on the order of 15 mm at each end of the finished billet 21.

Figure 5:
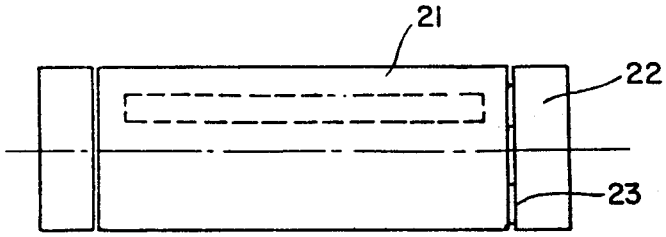
FIG. 5 is an axial half-cross-section of the billet for extrusion of Example 2, provided with welded-on blocks of extra length.

Finally, an extra length block of soft steel 22 of 60 mm length was TIG welded at each end of billet 21, with interrupted weld beads 23 (FIG. 5), with extra metal.

Billet 20 fitted with two extra length blocks 22 was extruded at 1160° C., temperature of the front face of the billet, by lubricated extrusion, with a cylinder having a diameter smaller than $\phi$ 119 mm and a die with a circular orifice of $\phi$ 22.5 mm, the auxiliary means known in the art. The maximum pressure developed in this extrusion was 14,000 kg/cm$^2$ (1370 MPa). The presence of the extra length block of soft steel at the front and of the extra length of agglomerated iron powder allowed drawing back of the part of the billet containing the refractory blanks and thus having a higher resistance of deformation, and as a result allowed for a lower pressure peak at the beginning of the extrusion.

The extruded composite bar which was obtained had a length of 12.4 meters. It was immersed in a 40% nitric acid bath until complete dissolution of the iron matrix, and after trimming of the ends, 75% of the initial weight of the refractory blanks was obtained in the form of rods of $\phi$ 1.2 mm, within diameter tolerances imposed by the use.

EXAMPLE 3

Manufacture of a Composite Billet Containing Profiled Rectangular Refractory Blanks, Extrusion of this Composite Billet and Obtaining Transformed Rods Starting with blanks or rods obtained by casting in sand and modified to the following dimensions:

sharply angled 4.5×6.3 mm rectangular cross section length: 225 mm analysis of the alloy (% by weight):

C−1.9−Si 1−Cr=28 Mn 1−W=9·Fe 3−Ni 0.2−Co=balance hardness HV 10=510.

A billet for extrusion was made composed of a bundle of 12 rods of 4.5×6.3 mm cross section, immersed in the iron powder according to the following process:

A rigid tube with an outside diameter of 96 mm and a height of 270 mm was provided with a flexible rubber sheathing of 2 mm thickness, the same diameter and 400 mm length, in its bore. A flexible sealing plug was placed on the bottom of the tube (10 mm thickness).

Two 4 mm thick and 91 mm diameter crossbars perforated with 12 holes of 0.9 mm on a concentric circumference were used to hold the blanks in place during powder filling.

These two crossbars were then withdrawn and the filing was completed with approximately 20 mm at each end, in order to obtain a powder height of 265 mm.

After placement of a sealing plug of 10 mm thickness on the top of the tube, the flexible sheathing was hermetically closed at the two ends.

The billet thus treated was placed in an isostatic compression enclosure and compressed under a pressure of 210 MPa.

The flexible rubber sheathing was removed from the billet after compression. Its mean dimensions were the following:

$\phi$ 76 mm×250 mm length.

The billet was sindered at 1150° C. under hydrogen to obtain better powder cohesion. Next it was machine finished to a dimeter of 73 mm and a length of 225 mm. Then an extra length block of soft steel 25 mm long, was welded at each end.

A 600 ton press was used for the extrusion. The billet was heated to 1150° C., the diameter of the die was 28 mm and the extruded bar was 1.3 m in length.

The bar which was obtained was immersed in a 40% nitric acid bath until complete dissolution of the iron matrix. After trimming, 75% of the initial product of the blanks was obtained in the form of rods of cross-section 2.3×1.6 mm, homothetic to that of the blanks, with the angles perfectly preserved.

Generally, greater weights of the refractory blanks in billets of the same dimensions, corresponding to the smaller spaces between the blanks than the spaces of Examples 2 and 3, can be used for the extrusion of refractory steels from billets manufactured according to the process of the invention.

This process can be applied to different shapes of billets and to different methods of manufacture of the billets from those described in the examples. This process also applies to other forms of blanks of metals or alloys which are difficult to transform, to other transformed products and to other means of transformation. Finally, various types of difficulties of transformation might arouse interest in the use of the process of the invention.

First of all, the composite billets of the invention can have various shapes, not only cylindrical, but can be, for example, parallelipipedic, flat or oval. The powder matrix which is agglomerated by compression and optionally completed by sintering or by oxidation decreases the total resistance to deformation, aids in lubrication and protects against shocks and various alterations. For assembly line work, the method described in Example 1 can be simplified thus utilizing advantageously blocks or blanks of precompressed powder associated with powder layers. It is also possible and advantageous to mix various types and/or qualities of powders in one single billet.

Various blanks in shape, which are difficult to transform are placed in the powder matrix. They are not only circular cylindrical, but also profiles of different cross sections, including flat and tubular. In a similar manner, the products transformed by hot deformation optionally followed by deformation at lower temperature and/or cold deformation the matrix having been eliminated either following the hot transformation or during the succeeding transformation have various forms. The hot transformation of the composite billet is accomplished by various processes such as extrusion, forging, hammering, rolling and wire drawing. This hot plastic deformation of the composite billet is optionally followed by warm or cold plastic deformation, by one of the processes known to those skilled in the art, for example, with an objective of dimensional gauging.

The process allows an economic resolution of the difficult problems of transformation when they are due to the extreme hardness of the metal or alloy being transformed. That is the case in Example 2. The process also applies to difficulties arising from the fragility of the metals or alloys to be transformed by virtue of the triple role of the agglomerated powder matrix: to decrease resistance to deformation, to lubricate, to protect. The function of protection of the covering allows transformation in the form of a composite billet according to the invention of metals or alloys which are heat alterable, even if they are contaminable by oxygen, nitrogen, hydrogen, or molten salts, in the case of preheating in salt baths.

Finally, the process is also used when the difficulty of transformation of the blank product is not solely technical, but when it arises from the problem of cost or timing. Thus, the extrusion of the billet acording to the invention allows a significant reduction of cross-section while preserving a close similarity to the cross-section of an enclosed blank, and it is possible to advantageously manufacture extruded elements from a billet according to the invention containing homothetic blanks of large cross section.

Because the compactness, the mechanical strength and the ductility of the powder matrix can be controlled, there is great flexibility in the process according to the invention. The factors influencing the quality and behavior of the matrix during hot deformation are notably: the quality and granulometries of the powders used, for example, iron, copper, aluminum powders, coated powders, the optional introduction of a compression lubricant and/or a solid lubricant which is resistant to high temperature, such as graphite or molybdenum bisulfide, the more or less thorough agglomeration including either one single compression or one single sintering or a compression followed by a sintering or an oxidation, and the optional impregnation of the billet by a liquid or pasty lubricant. Such factors influence the deformation resistance of the composite billet of the invention straight above the contained blanks, and this resistance is also dependent and can be predominantly dependent upon the relation of cumulative cross-section of the blanks to the cross-section of the billet and the resistance to deformation of these blanks. Besides, the extra thickness of powder and the optional addition of the blocks of extra thickness can also modify the behavior of the billet to hot deformation and the quality of the results, for example in the area of uniformity of dimensions of the products obtained.

Very high quality powders can be used in the process according to the invention. The powder grain dimensions, not necessarily all the same, can be from 2 microns to 2 mm, and their composition can very within the matrix and in addition, the grains of powder can be either exposed or coated.

One important advantage of the process according to the invention is the ease of extraction of the products after transformation of the composite billet: attack and chemical dissolution of the agglomerated powder matrix are much easier than attack and chemical dissolution of a covering according to the prior art, whether this covering is solid or is in powder form and has an outer covering.

What is claimed is:

1. Process for making a composite billet for hot transformation, including at least one difficult to transform metal or alloy blank, arranged in a matrix of agglomerated metal powder, said matrix having a lower resistance to hot plastic deformation than that of said metal or alloy, comprising the following steps:

(a) packing down said metal powder around said blanks within a rigid cylindrical sheathing lined on its interior with a flexible sheathing which is longer than said rigid sheathing, to form a billet;

(b) closing said flexible sheathing around the ends of said billet under a vacuum, and removing said rigid cylindrical sheathing;

(c) compressing said closed, flexibly sheathed billet, causing at least partial agglomeration of said metal powder;

(d) removing said flexible sheathing from said at least partially agglomerated metal powder to obtain said billet for hot transformation.

2. Process according to claim 1, wherein said step of compressing takes place in an isostatic compression enclosure.

3. Process according to claim 1, additionally comprising a step of sintering following said step of removing said flexible sheathing, thereby improving the agglomeration of said powder.

4. Process according to claim 1, wherein said blanks are circular cylindrical or are profiles of various cross-sections.

5. Process according to claim 1, wherein said matrix consists essentially of iron powder.

6. Process according to claim 5, wherein said step of compressing is followed by an oxidation between 200° and 600° C.

7. Process according to claim 6, wherein said oxidized billet is impregnated with a liquid or pasty lubricant.

8. Process according to claim 1, wherein at least one solid lubricating powder is incorporated into the powder of said matrix.

9. Process according to claim 1, wherein at least a part of the powder of said matrix is precompressed before positioning said blanks in said matrix.

10. Process according to claim 1, wherein said billet for hot transformation is extended in length by attachment of a metal block at at least one end, said block having a lower resistance to hot plastic transformation than that of said metal or alloy.

11. Process according to claim 1, wherein during said step of packing down said metal powder, said rigid and flexible sheathing are mounted vertically on a sealing plug which is removed subsequent to said packing step.

12. Process according to claim 1, wherein during said step of packing down said metal powder, said blanks are held in place with at least one crossbar which is removed subsequent to said packing step, before said closing step.

13. Process according to claim 1, wherein subsequent to said packing step and prior to the closing of said flexible sheathing, a semi-rigid plug is placed against said packed powder at at least on end of said billet, said semi-rigid plug being removed subsequent to said step of compression.

14. Process for hot transformation of difficult to transform metal or alloy blanks, comprising the steps of:

(a) forming a composite billet for hot transformation according to the method of claim 1;

(b) hot transforming said composite billet by extrusion through a die; and (c) removing said powder to obtain transformed blanks.

15. Method according to claim 14, wherein said powder is removed by dissolving with acid.

16. Method according to claim 14, wherein said blanks comprise refractory metals or alloys.

17. Process according to claim 14, wherein said blanks comprise brittle metal or alloys.

18. Process according to claim 14, wherein said blanks comprise heat alterable metals or alloys.

19. Process according to claim 14, additionally comprising the step of cold transforming said transformed blanks subsequent to the removal of said matrix.

20. Transformed metal or alloy blanks obtained by the method of claim 14.

21. Transformed metal or alloy blanks obtained according to the method of claim 19.

* * * * *